US005996502A

United States Patent [19]

Endicott, Jr. et al.

[11] Patent Number: 5,996,502

[45] **Date of Patent: *Dec. 7, 1999**

[54] PLUME ENHANCEMENT NOZZLE FOR ACHIEVING FLARE ROTATION

[75] Inventors: David W. Endicott, Jr., Mendon; Ross W. Guymon, Providence; Ralph S. Tappan, II, Brigham City, all of Utah

[73] Assignee: Cordant Technologies Inc., Salt Lake City, Utah

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/863,399

[22] Filed: May 27, 1997

Related U.S. Application Data

[63] Continuation of application No. 08/495,716, Jun. 27, 1995, Pat. No. 5,654,522.

[51] Int. Cl.[6] ..... F42B 4/06

[52] U.S. Cl. ..... 102/350; 102/358; 102/359; 102/370; 102/336; 244/3.26

[58] Field of Search ..... 102/350, 358, 102/359, 370, 336; 244/3.26

[56] References Cited

U.S. PATENT DOCUMENTS

| | | | |
|---|---|---|---|
| 17,886 | 7/1857 | McConnel | 102/350 |
| 23,468 | 4/1859 | Hyde | 102/350 |
| 37,940 | 3/1863 | Plant | 102/350 |
| 1,305,188 | 5/1919 | Bergman | 102/350 |
| 2,398,545 | 4/1946 | Millan et al. | 102/37.8 |
| 2,701,984 | 2/1955 | Terce | 89/1.7 |
| 3,058,423 | 10/1962 | Laager | 102/51 |
| 3,479,954 | 11/1969 | Bolieau | 102/37.8 |
| 3,724,781 | 4/1973 | Makow | 102/350 |
| 3,751,037 | 8/1973 | Courneya | 244/3.23 X |
| 3,754,725 | 8/1973 | Kartzmark et al. | 244/3.23 |
| 3,855,789 | 12/1974 | Platzek | 60/255 |
| 4,964,593 | 10/1990 | Kranz | 244/3.24 |
| 5,035,182 | 7/1991 | Purcell et al. | 102/481 |
| 5,074,216 | 12/1991 | Dunne et al. | 102/334 |
| 5,400,712 | 3/1995 | Herbage et al. | 102/336 X |
| 5,427,032 | 6/1995 | Hiltz et al. | 102/330 X |
| 5,654,522 | 8/1997 | Endicott, Jr. et al. | 102/350 |

FOREIGN PATENT DOCUMENTS

| | | | |
|---|---|---|---|
| 2162622 | 2/1986 | United Kingdom | 102/336 |
| 2266944 | 11/1993 | United Kingdom | 102/336 |

*Primary Examiner*—Peter A. Nelson
*Attorney, Agent, or Firm*—Pillsbury Madison & Sutro Intellectual Property Group

[57] ABSTRACT

An aerodynamically stable, kinematic flare having an enhanced plume signature is disclosed. The flare includes a housing with a flare illuminant disposed within the housing. A primary nozzle is configured in the aft wall of the housing. Four secondary nozzles are configured in the aft end of the side wall of the housing and are positioned aft of the center of gravity of the flare. At least two of the secondary nozzles comprise off-center nozzles having a longitudinal axis which does not extend through the longitudinal axis of the flare. A shroud is attached to the housing and deploys to an extended position upon combustion of the illuminant. The shroud is configured with holes which correspond in size and position to each of the secondary nozzles when the shroud is in its extended position. The primary and secondary nozzles are sized and positioned to spin stabilize the flare during combustion of the illuminant.

23 Claims, 3 Drawing Sheets

PLUME ENHANCEMENT NOZZLE FOR ACHIEVING FLARE ROTATION

This is a continuation of application Ser. No. 08/495,716, filed Jun. 27, 1995, now U.S. Pat. No. 5,694,522.

BACKGROUND

1. The Field of the Invention

The present invention is related to a nozzle for use on a decoy flare. More particularly, the present invention is related to a nozzle positioned off-axis to increase the effective cross-sectional area of the plume of a decoy flare as a function of aspect angle.

2. Technical Background

Decoy flares are used defensively by combat aircraft to evade heat-seeking missiles directed at such aircraft by an enemy. At an appropriate time after the enemy launches a heat-seeking missile, the targeted aircraft releases a decoy flare. The decoy flare burns in a manner that simulates the engines of the targeted aircraft. Ideally, the missile locks onto and pursues the decoy, permitting the targeted aircraft to escape unharmed.

Early decoy techniques utilized bundles of chaff, i.e., strips of metal which would reflect radar energy to counter radar guided missiles. The chaff bundles were housed in square or rectangular shaped cartridges which were held in correspondingly shaped dispensers on the aircraft.

However, the advancement of missile technology has resulted in the development of missiles which examine a potential target's energy spectrum in order to distinguish decoys from targeted aircraft using infrared wavelength signatures. Typical of such missiles are missiles which target an infrared light source.

The burn requirements of the decoy flare must therefore be determined by reference to the known characteristics of the targeted aircraft's engine emissions as interpreted by the heat-seeking missile. It is necessary for the decoy to emit light in the infrared (IR) spectrum and for a duration that will induce the missile to lock onto the decoy instead of the escaping aircraft.

One problem which has been encountered in the development of suitable IR decoy flares is the difficulty of achieving a sufficiently large plume by the decoy flare. Of course, as the cross-sectional area of the plume of the decoy flare is increased, the likelihood that the missile will lock onto the decoy flare, instead of the target aircraft, also increases.

One proposed solution for achieving a larger plume area is to utilize larger flares. This solution is problematic because the design envelope of the flare is preferably limited by that which can be contained within a chaff dispenser cartridge. Also, increasing the size of the decoy flare increases the airplane payload due to flares which may ultimately result in a reduction in the number of flares which can be carried.

Another challenge facing flare designers is the difficulty of designing a flare which is stable in flight. Because chaff dispenser cartridges are rectangular in cross section, maximization of this available area has resulted in flares which are also rectangular in cross section. Such geometries do not lend easily themselves to stable flight.

From the foregoing, it will be appreciated that it would be an advancement in the art to provide a decoy flare which is capable of emitting a combustion plume having a greater cross-sectional area without increasing the physical dimensions or weight of the flare, thereby permitting the flare to be used with presently existing chaff dispensers without increasing the payload of the aircraft from which the flare is to be launched.

It would be a further advancement in the art to provide such a flare which had a rectangular cross section, thereby enabling it to maximize the available area within a chaff dispenser cartridge, yet which would be stable in flight.

Such a device is disclosed and claimed herein.

BRIEF SUMMARY AND OBJECTS OF THE INVENTION

The present invention is directed to a novel, aerodynamically stable, kinematic flare having enhanced plume signature. The flare includes a housing which has a rectangular cross section. The housing includes an aft wall and a side wall. The aft wall is positioned generally perpendicular to the longitudinal axis of the flare. The side wall extends generally parallel to the longitudinal axis of the flare.

A combustible flare illuminant is disposed within the housing. A primary nozzle is configured in the aft wall of the housing and four secondary nozzles are configured in the aft end of the side wall of the housing. Each of the secondary nozzles is positioned aft of the center of gravity of the flare.

In a preferred embodiment, at least two of the secondary nozzles comprise off-center nozzles having a longitudinal axis which does not extend through the longitudinal axis of the flare. The perpendicular distance from the longitudinal axis of each off-center nozzle to the longitudinal axis of the flare is the same. Two additional secondary nozzles are positioned with their respective longitudinal axes extending through the longitudinal axis of the flare.

The secondary nozzles preferably have a diameter of from about 0.25 inches to about 0.375 inches, with the primary nozzle having a diameter of from about 0.5 inches to about 1.0 inches. In one presently preferred embodiment, the secondary nozzles have a diameter of about 0.375 inches and the primary nozzle has a diameter of about 0.8 inches. It is presently preferred that the secondary nozzles be configured to provide from about 10 to about 15 percent, and preferably about 13 percent, of the total thrust to the flare during combustion of the illuminant.

A shroud is attached to the housing and is configured for deployment to an extended position in which the shroud extends beyond the aft end of the housing. The shroud is further configured with holes which correspond in size and position to each of the secondary nozzles when the shroud is in its extended position. Thus, when the shroud is in the extended position, the secondary nozzles are vented to the ambient air.

The primary and secondary nozzles are sized and positioned to spin stabilize the flare during combustion of the illuminant. The off-center nozzles are preferably configured to spin the flare from about 10 to about 12 revolutions per second during combustion of the illuminant.

In operation, upon deployment of the flare, the shroud moves to its extended position and the illuminant within the housing is ignited. As the illuminant combusts, combustion gases flow out the primary nozzle and out each of the secondary nozzles. The flow of combustion gases out of the off-center nozzles cause the flare to spin. As the flare spins, the plumes generated at the secondary nozzles effectively merge to form a solid ring. Thus, when the flare is viewed from the aft end, the cross-sectional area of the total flare plume is greatly enhanced. The spinning of the flare also assists in stabilizing its flight.

Thus, it is an object of the present invention to provide a decoy flare which is capable of emitting a combustion plume having a greater cross-sectional area without increasing the physical dimensions or weight of the flare, thereby permitting the flare to be used with presently existing chaff dispensers without increasing the payload of the aircraft from which the flare is to be launched.

It is a further object of the present invention to provide such a flare which has a rectangular cross section, thereby enabling it to maximize the available area within a chaff dispenser cartridge, yet which is stable in flight.

These and other objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
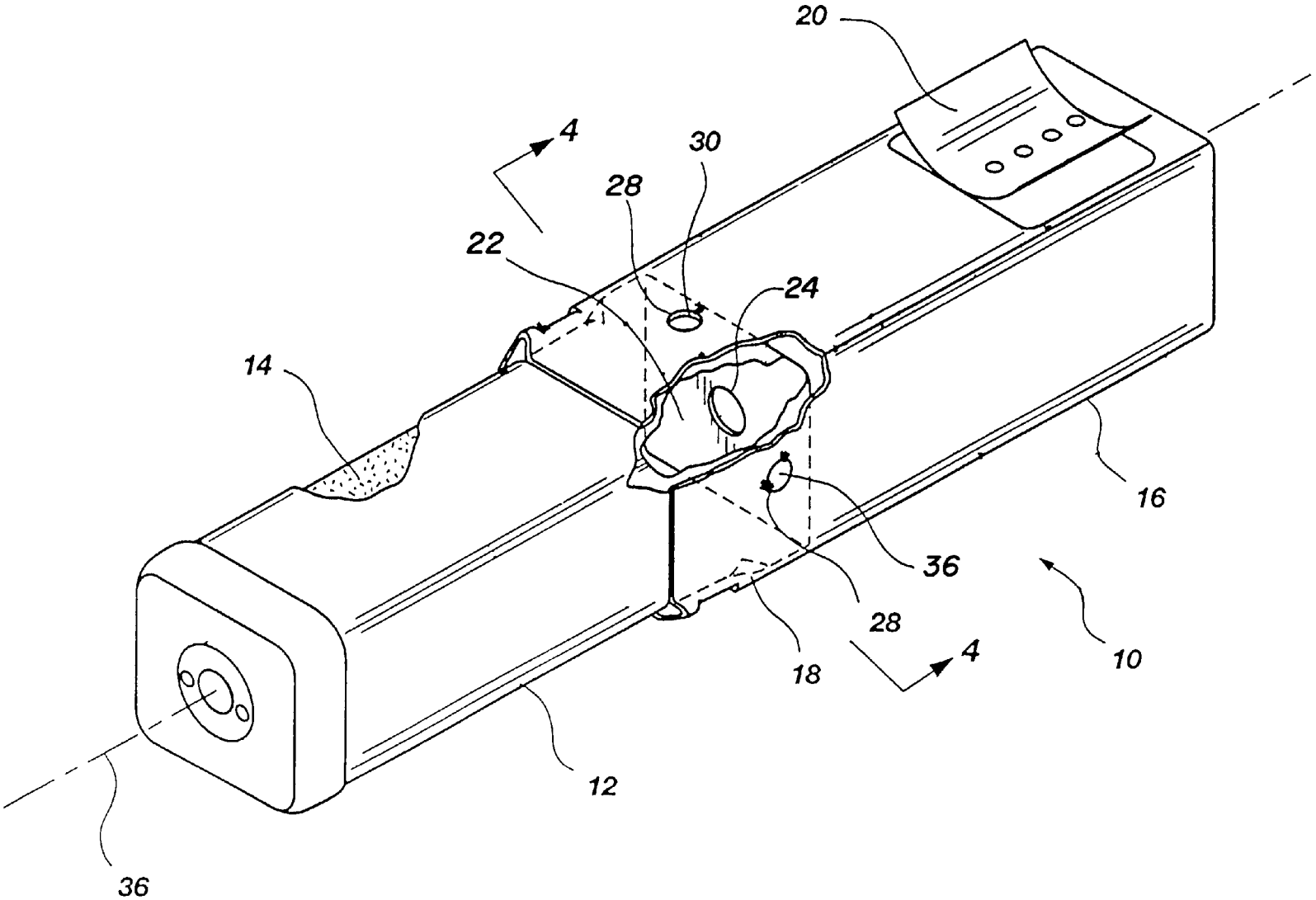
FIG. 1 is a perspective view of a preferred embodiment of the decoy flare of the present invention.

Reference is now made to the figures wherein like parts are referred to by like numerals throughout. With particular reference to FIG. 1, a kinematic flare according to the present invention is generally designated at 10. The flare 10 includes a housing 12 in which illuminant 14 is disposed. The housing 12 is configured with a rectangular cross section which is sized to permit the flare to be packaged within preexisting chaff dispensers which are commonly found on aircraft—about 2.50 inches by about 2.0 inches.

The illuminant 14 preferably comprises a propellant composition, thereby enabling the decoy flare 10 to be propelled in a direction which is beneficial in countering air-to-air and surface-to-air missiles. The illuminant may comprise any of those known compositions which produce radiation upon combustion. The illuminant may be tailored to produce light over a variety of wavelengths, including visible and/or infrared light.

The flare 10 also includes a shroud 16 which is slidably attached to the housing 12 for deployment from a retracted position (not shown), to the extended position illustrated in FIG. 1. During storage of the flare and prior to deployment, the shroud is maintained in the retracted position. Upon deployment of the flare and ignition of the illuminant, the shroud is deployed to the extended position. A locking mechanism 18 maintains the shroud in the extended position, as is commonly known in the art of decoy flares.

The housing 12 and shroud 16 may be manufactured from any of those materials known for use in such an application, but are preferably made of carbon-steel or 304 stainless steel seamless tubing.

A pair of fins 20 are preferably attached on opposite sides of the shroud 16 towards the aft end of the shroud. As best seen in FIG. 1, the fins 20 are generally configured as half cylindrical shells. As is known in the art, the fins 20 are made of a flexible material thereby permitting them to lie substantially flat against the shroud prior to deployment of the flare. Thus, the flare may be stowed in a rectangular dispenser having approximately the same cross-sectional geometry as the shroud. Upon deployment of the flare 10, the fins 20 are released to assume the configuration illustrated in FIG. 1 and assist in providing aerodynamic stability to the flare during flight.

The housing 12 includes an aft wall 22 which is configured with a primary nozzle 24 through which combustion gases are discharged during combustion of the illuminant 14. The primary nozzle 24 may be configured in a variety of geometries, but is preferably round. It is presently preferred that the primary nozzle 24 be configured with a diameter of from about 0.5 inches to about 1.0 inches. Upon combustion of the illuminant, a plume of combustion gases is discharged through the primary nozzle 24.

In accordance with the teachings of the present invention, the housing 12 also includes a side wall 26. At least one secondary nozzle 28 is configured in the side wall 26. In the presently preferred embodiment of the invention illustrated in FIG. 1, the side wall 26 is configured with four secondary nozzles 28. Each of the secondary nozzles 28 is preferably positioned aft of the center of gravity of the flare 10, thereby contributing to the aerodynamic stability of the flare. In the presently preferred embodiment, the secondary nozzles 28 are circular with a diameter of from about 0.25 inches to about 0.375 inches.

The secondary nozzles are preferably configured to provide from about 10 to about 15 percent of the total thrust to the flare during combustion of the illuminant. In this presently preferred embodiment, the secondary nozzles provide about 13 percent of the total thrust to the flare during combustion of the illuminant.

Figure 2:
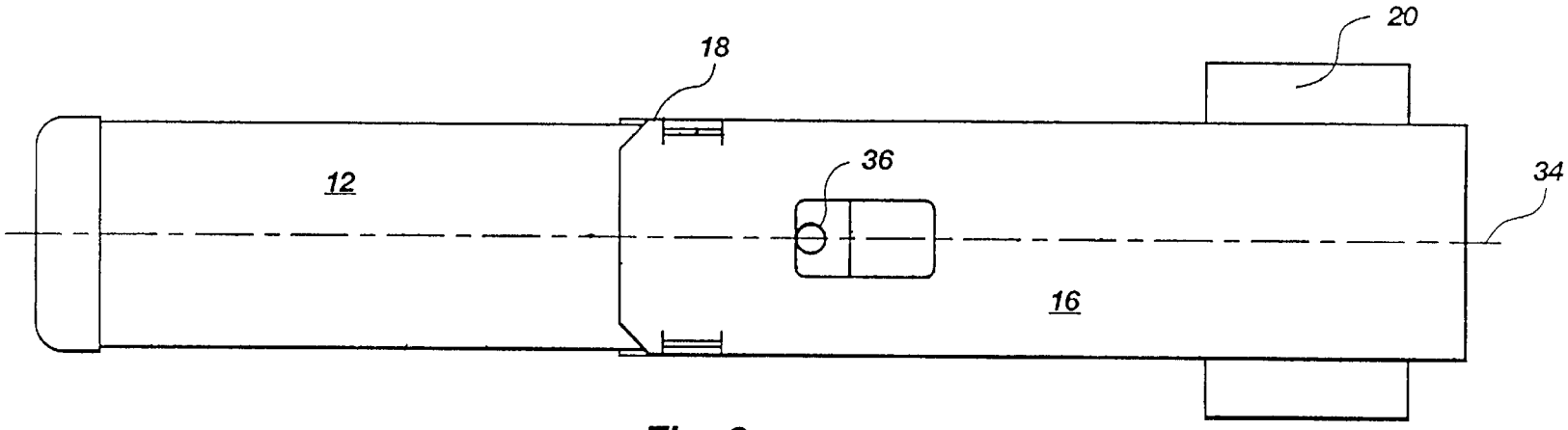
FIG. 2 is a side plan view of the flare of FIG. 1.
Figure 3:
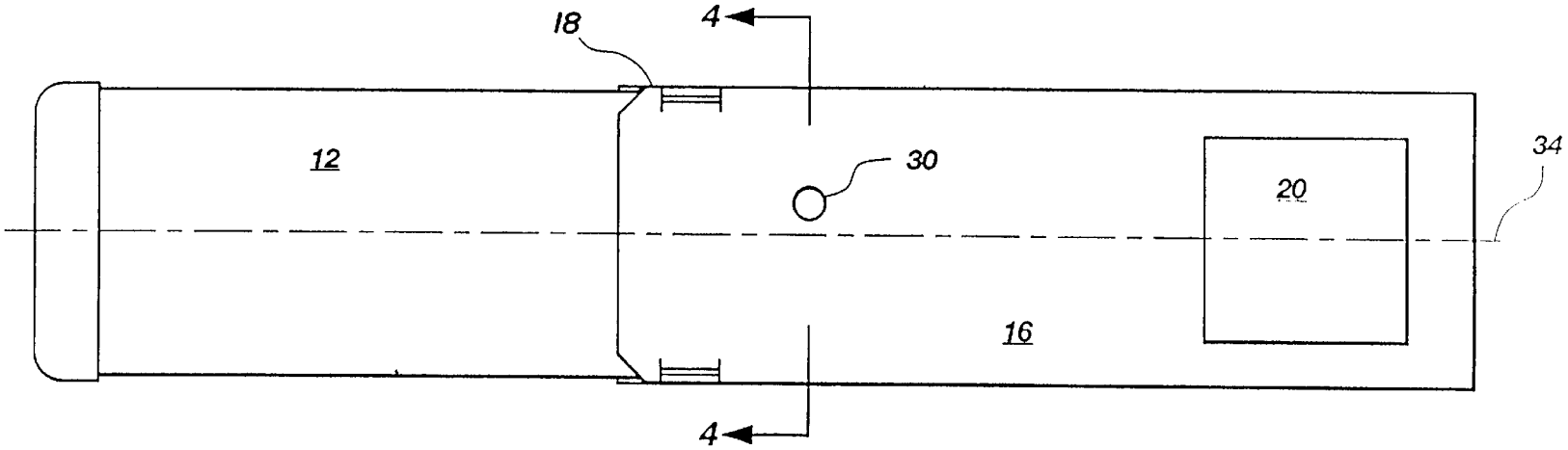
FIG. 3 is a side plan view of an adjacent side to that illustrated in FIG. 2.
Figure 4:
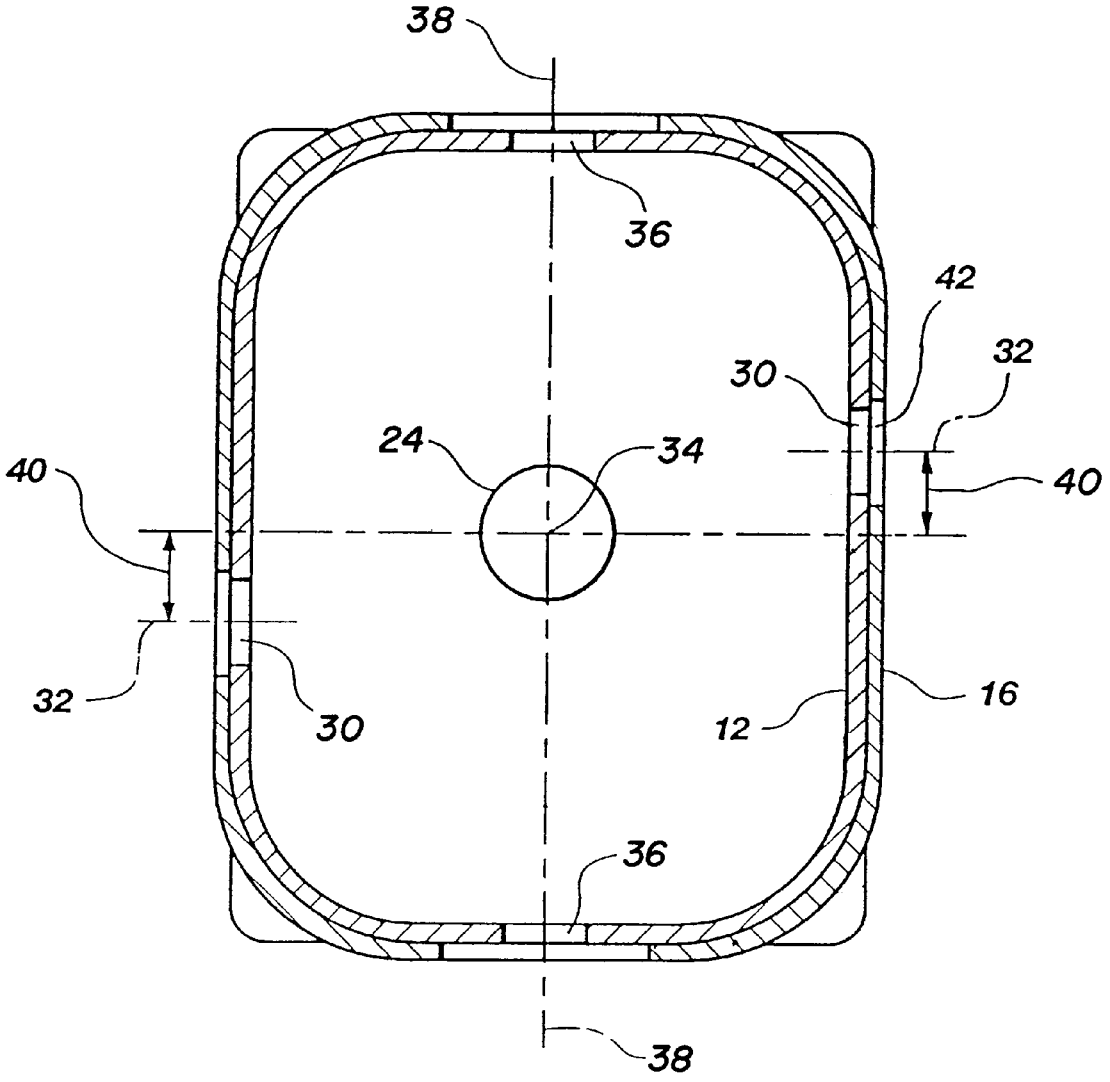
FIG. 4 is a cross-sectional view of taken along line 4—4 of FIG. 1.

The flare also includes means for rotating the flare about its longitudinal axis during combustion of the illuminant. As best illustrated with reference to FIGS. 2 through 4, one presently preferred rotating means comprises at least one, and preferably at least two, secondary nozzles 28 which are configured as off-center nozzles 30 (FIGS. 3 and 4). Each of the off-center nozzles 30 has a longitudinal axis 32 which does not extend through the longitudinal axis 34 of the flare yet is perpendicular to the side wall of the housing. The remaining secondary nozzles 36 are positioned with their respective longitudinal axes 38 extending through the longitudinal axis 34 of the flare (FIGS. 2 and 4).

In this embodiment of the present invention, the secondary nozzles 28 are configured by simply forming a hole, such as by drilling, in the side wall 26 of the housing 12. In alternative embodiments, however, the secondary nozzles include nozzles mounted in the side wall 26 which may be vectored. Such off-center nozzles may be vectored such that the longitudinal axis of the nozzle does not extend through the longitudinal axis of the flare.

As illustrated in FIG. 4, it is presently preferred that the flare include two off-center nozzles 30 and two on-axis nozzles 36. The off-center nozzles 30 are positioned on opposite sides of the housing 12 as are the two on-axis nozzles 36. Thus, each wall in the side wall 26 of the housing 12 includes a secondary nozzle 28.

In the preferred embodiment of the present invention illustrated in FIG. 1, the perpendicular distance 40 from the longitudinal axis 32 of each off-center nozzle 30 to the longitudinal axis of the flare is the same. Thus, the moment applied to the flare at each off-center nozzle 30 is approximately the same.

The rotating means may also include other configurations for achieving rotation of the flare during combustion of the illuminant. Such configurations include the use of fins, vanes, or other mechanisms for achieving rotation which are known to those of skill in the art, all of which are within the scope of the present invention.

As best illustrated in FIG. 4, the shroud 16 is configured with holes 42 which correspond in size and position to each of the secondary nozzles 28 when the shroud is in its extended position (FIG. 1). Thus, the use of a shroud will not interfere with the discharge of combustion products through the secondary nozzles 28.

The primary and secondary nozzles are sized and positioned to spin stabilize the flare during combustion of the illuminant. In this preferred embodiment, this is achieved by configuring the off-center nozzles to spin the flare from about 10 to about 12 revolutions per second during combustion of the illuminant. In this embodiment, this is achieved by configuring the primary nozzle 24 with a diameter of about 0.8 inches and the secondary nozzles with a diameter of about 0.375 inches and configuring the flare with an off-set distance 40 of about 0.10 inches.

In operation, the flare is deployed by firing an ignition mechanism such as an impulse cartridge (not shown) which ejects the flare from its storage canister. For flares deployed from military aircraft, the storage canister will typically be a chaff dispenser cartridge.

Upon firing of the impulse cartridge, the shroud 16 deploys to the position illustrated in FIG. 1, is locked into place, and the illuminant 14 is ignited. As the illuminant combusts, combustion gases flow out the primary nozzle 24 and out each of the secondary nozzles 28.

The flow of combustion gases out of the off-center nozzles 30 imposes a moment on the flare which causes the flare to spin. The spinning of the flare stabilizes its flight. Additionally, as the flare spins, the plumes generated at the secondary nozzles 28 effectively merge to form a solid ring. Thus, when the flare is viewed, particularly from the forward or aft end, the cross-sectional area of the total flare plume is greatly enhanced.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A kinematic flare having enhanced plume signature, the flare having a longitudinal axis, comprising:

a housing including an aft wall positioned generally perpendicular to the longitudinal axis of the flare and a side wall extending generally parallel to the longitudinal axis of the flare;

illuminant disposed within the housing;

a primary nozzle configured in the aft wall of the housing;

at least one secondary nozzle configured in the side wall of the housing;

means for rotating the flare about its longitudinal axis during combustion of the illuminant; and a shroud attached to the housing, the shroud being deployable from a retracted position to an extended position in which the shroud extends beyond the aft end of the housing, the shroud configured with holes which correspond in position to each of the secondary nozzles when the shroud is in the extended position.

2. A kinematic flare as defined in claim 1, wherein the means for rotating the flare comprises at least one secondary nozzle configured as an off-center nozzle having a longitudinal axis which does not extend through the longitudinal axis of the flare.

3. A kinematic flare as defined in claim 2, wherein the means for rotating the flare comprises at least two of the secondary nozzles configured as off-center nozzles each having a longitudinal axis which does not extend through the longitudinal axis of the flare.

4. A kinematic flare as defined in claim 3, wherein the perpendicular distance from the longitudinal axis of each off-center nozzle to the longitudinal axis of the flare is the same.

5. A kinematic flare as defined in claim 2, wherein the primary and secondary nozzles are sized and positioned to spin stabilize the flare during combustion of the illuminant.

6. A kinematic flare as defined in claim 1, further comprising at least two secondary nozzles positioned with their respective longitudinal axes extending through the longitudinal axis of the flare.

7. A kinematic flare as defined in claim 1, wherein the secondary nozzles are positioned aft of the center of gravity of the flare.

8. A kinematic flare as defined in claim 7, wherein the secondary nozzles are positioned at the aft end of the housing.

9. A kinematic flare having enhanced plume signature, the flare having a longitudinal axis, comprising:

a housing including an aft wall positioned generally perpendicular to the longitudinal axis of the flare and a side wall extending generally parallel to the longitudinal axis of the flare;

illuminant disposed within the housing;

a primary nozzle configured in the aft wall of the housing;

at least one secondary nozzle configured in the aft end of the side wall of the housing and positioned aft of the center of gravity of the flare, at least two of the secondary nozzles comprising off-center nozzles having a longitudinal axis which does not extend through the longitudinal axis of the flare, the perpendicular distance from the longitudinal axis of the flare being the same; and a shroud attached to the housing, the shroud being deployable from a retracted position to an extended position in which the shroud extends beyond the aft end of the housing, the shroud configured with holes which correspond in position to each of the secondary nozzles when the shroud is in the extended position.

10. A kinematic flare as defined in claim 9, wherein at least two of the secondary nozzles are positioned with their respective longitudinal axes extending through the longitudinal axis of the flare.

11. A kinematic flare as defined in claim 10, comprising four secondary nozzles, at least two of the four secondary nozzles comprising off-center nozzles.

12. A kinematic flare as defined in claim 9, wherein the housing has a rectangular cross section.

13. A kinematic flare having enhanced plume signature, the flare having a longitudinal axis, comprising:

a housing including an aft wall positioned generally perpendicular to the longitudinal axis of the flare and a side wall extending generally parallel to the longitudinal axis of the flare;

illuminant disposed within the housing;

a primary nozzle configured in the aft wall of the housing;

at least two secondary off-center nozzles configured in opposite sides of the side wall of the housing and having respective longitudinal axes which do not extend through the longitudinal axis of the flare yet are perpendicular to the side wall of the housing, the secondary off-center nozzles being positioned to rotate the flare about its longitudinal axis during combustion of the illuminant; and at least two secondary on-center nozzles positioned with their respective longitudinal axes extending through the longitudinal axis of the flare.

14. A kinematic flare having enhanced plume signature, the flare having a longitudinal axis, comprising:

a housing including an aft wall positioned generally perpendicular to the longitudinal axis of the flare and a side wall extending generally parallel to the longitudinal axis of the flare;

illuminant disposed within the housing;

a primary nozzle configured in the aft wall of the housing; and at least one secondary nozzle configured in the aft end of the side wall of the housing and positioned aft of the center of gravity of the flare, at least two of the secondary nozzles comprising off-center nozzles having a longitudinal axis which does not extend through the longitudinal axis of the flare, the perpendicular distance from the longitudinal axis of the flare being the same, wherein the primary and secondary nozzles are sized and positioned to spin stabilize the flare during combustion of the illuminant, and wherein the housing has a rectangular cross section.

15. A kinematic flare having enhanced plume signature, the flare having a longitudinal axis, comprising:

a housing including an aft wall positioned generally perpendicular to the longitudinal axis of the flare and a side wall extending generally parallel to the longitudinal axis of the flare;

illuminant disposed within the housing;

a primary nozzle configured in the aft wall of the housing; and at least two secondary off-center nozzles configured in opposite sides of the side wall of the housing and having respective longitudinal axes which do not extend through the longitudinal axis of the flare yet are perpendicular to the side wall of the housing, the secondary off-center nozzles being positioned to rotate the flare about its longitudinal axis during combustion of the illuminant.

16. A kinematic flare as defined in claim 15, wherein the perpendicular distance from the longitudinal axis of each the two secondary off-center nozzles to the longitudinal axis of the flare is the same.

17. A kinematic flare as defined in claim 15, wherein the housing has a rectangular cross section, and wherein the primary and secondary nozzles are sized and positioned to spin stabilize the flare during combustion of the illuminant.

18. A kinematic flare as defined in claim 15, wherein the secondary nozzles are positioned aft of the center of gravity of the flare.

19. A kinematic flare as defined in claim 15, wherein the housing has a rectangular cross section.

20. A kinematic flare as defined in claim 13, wherein the perpendicular distance from the longitudinal axis of each the two secondary off-center nozzles to the longitudinal axis of the flare is the same.

21. A kinematic flare as defined in claim 13, wherein the housing has a rectangular cross section, and wherein the primary and secondary nozzles are sized and positioned to spin stabilize the flare during combustion of the illuminant.

22. A kinematic flare as defined in claim 13, wherein the secondary nozzles are positioned aft of the center of gravity of the flare.

23. A kinematic flare as defined in claim 13, wherein the housing has a rectangular cross section.

* * * * *